US010208551B2

(12) United States Patent
Rytlewski

(10) Patent No.: US 10,208,551 B2
(45) Date of Patent: Feb. 19, 2019

(54) WELL SYSTEM WITH SETTABLE SHOULDER

(71) Applicant: Schlumberger Technology Corporation, Sugar Land, TX (US)

(72) Inventor: Gary Rytlewski, League City, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 225 days.

(21) Appl. No.: 15/172,539

(22) Filed: Jun. 3, 2016

(65) Prior Publication Data

US 2016/0356109 A1 Dec. 8, 2016

Related U.S. Application Data

(60) Provisional application No. 62/170,550, filed on Jun. 3, 2015.

(51) Int. Cl.
*E21B 23/01* (2006.01)
*E21B 43/12* (2006.01)

(52) U.S. Cl.
CPC ..... *E21B 23/01* (2013.01); *E21B 43/128* (2013.01)

(58) Field of Classification Search
CPC ..... E21B 23/01; E21B 43/128
See application file for complete search history.

(56) References Cited

U.S. PATENT DOCUMENTS

2008/0196880 A1* 8/2008 Head ..... E21B 33/1275 166/66.4
2011/0168406 A1* 7/2011 Du ..... E21B 17/023 166/380
2012/0024543 A1* 2/2012 Head ..... E21B 17/10 166/382

* cited by examiner

*Primary Examiner* — Caroline N Butcher

(57) ABSTRACT

A system for use in a well includes a completion system having a shoulder contact region, an electric submersible pumping system deployed downhole via a cable for landing on the completion system, a tubular member coupled to the electric submersible pumping system and extending downhole from the electric submersible pumping system, and a shoulder mechanism slidably mounted on the tubular member for engagement with the shoulder contact region during landing, the shoulder mechanism being selectively settable along the tubular member to counter tensile loading in the cable. The shoulder mechanism is set against the tubular member via anchors actuated against the tubular member, and the anchors are actuated by a piston movably mounted within a housing of the shoulder mechanism.

15 Claims, 5 Drawing Sheets

WELL SYSTEM WITH SETTABLE SHOULDER

CROSS-REFERENCE TO RELATED APPLICATION

The present document is based on and claims priority to U.S. Provisional Application Ser. No. 62/170,550 filed Jun. 3, 2015, which is incorporated herein by reference in its entirety.

BACKGROUND

Oil and gas wells utilize a borehole drilled into the earth and subsequently completed with equipment to facilitate production of desired fluids from a reservoir. A pumping system, e.g. an electric submersible pumping system, may be deployed downhole into the borehole and operated to pump fluids. In some applications, the electric submersible pumping system is deployed downhole by cable. However, when long lengths of cable are deployed and/or when the pumping system is operated the cable can experience substantial tensile loading. In some applications, a packer has been used in combination with the submersible pumping system to help support the pumping system and to limit tensile loading of the cable. However, removing the pumping system and packer involves a costly workover well intervention.

SUMMARY

In general, a system and methodology facilitate placement of a pumping system, e.g. an electric submersible pumping system, in a borehole. The pumping system is deployed downhole into the borehole via a cable or other suitable conveyance and then landed on a completion system disposed in the borehole. The pumping system is combined with a tubular member and a shoulder mechanism slidably mounted along the tubular member. The shoulder mechanism may be selectively set and locked to the tubular member. When the pumping system is deployed downhole, the shoulder mechanism is allowed to move along the tubular member after engaging a corresponding shoulder contact region of the completion system. Once the pumping system is properly deployed, the shoulder mechanism may be set against the tubular member to support the submersible pumping system and to counter axial loading during testing and/or operation of the submersible pumping system.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The present disclosure generally relates to a system and methodology which facilitate placement of a pumping system, e.g. an electric submersible pumping system, in a borehole. The technique utilizes a settable load shoulder mechanism which can be used to counter tensile loading in a conveyance, e.g. cable, while also facilitating a land out procedure. In this type of embodiment, the pumping system may be deployed downhole into the borehole via a cable and landed on a completion system disposed in the borehole.

In a specific example, the pumping system is an electric submersible pumping system which may be combined with a tubular member and a settable shoulder mechanism. The shoulder mechanism is slidably mounted along the tubular member and may be selectively set and locked to the tubular member. When the electric submersible pumping system is deployed downhole, the shoulder mechanism is initially in a lower or bottom position but it is allowed to move along the tubular member after engaging a corresponding shoulder contact region of the completion system. In some embodiments, the shoulder mechanism may temporarily be secured at the lower or bottom position by, for example, a shear member. Once the electric submersible pumping system is properly deployed, the shoulder mechanism may be set against the tubular member to support the submersible pumping system and to counter axial loading during testing and/or operation of the electric submersible pumping system.

Figure 1:
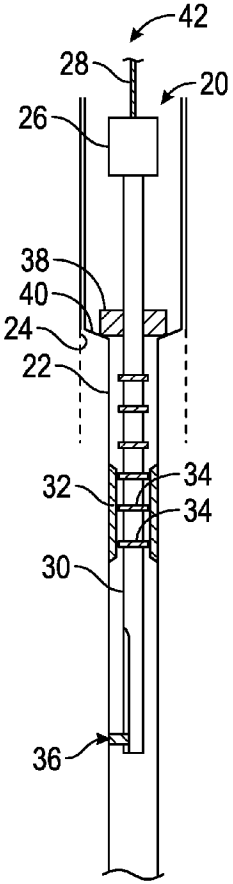
FIG. 1 is a schematic illustration of a submersible pumping system combined with a settable shoulder and deployed downhole into engagement with a corresponding completion system, according to an embodiment of the disclosure.

Referring generally to FIG. 1, an embodiment of a pumping system 20 is illustrated as being deployed into engagement with a downhole completion system 22 located in a borehole 24, e.g. a wellbore. The pumping system 20 may be constructed in a variety of configurations depending on the particular application or environment in which the pumping system 20 is employed. For example, pumping system 20 may be in the form of an electric submersible pumping system 26 having a variety of components selected according to the parameters of a given operation. According to an embodiment, the electric submersible pumping system 26 comprises a submersible motor, a motor protector, and a submersible pump powered by the submersible motor.

The electric submersible pumping system 26 may be conveyed downhole by a cable 28, e.g. an electric power cable, or other suitable conveyance. Additionally, a tubular member 30 extends from the electric submersible pumping system 26 generally in alignment with borehole 24. Depending on the application, well fluid may be drawn through tubular member 30 to electric submersible pumping system 26 during production. As illustrated, the tubular member 30 may be coupled to the electric submersible pumping system 26 such that it extends downhole from the electric submersible pumping system 26 during deployment. In at least some applications, the tubular member 30 may be in the form of a stinger which is sealingly received in a polished bore receptacle 32. Various types of seals 34 may be used to facilitate sealing engagement between the stinger 30 and the polished bore receptacle 32. Depending on the application, an orientation mechanism 36 may be used in cooperation with the tubular member 30 to properly orient the tubular member and/or resist rotational torque.

Figure 2:
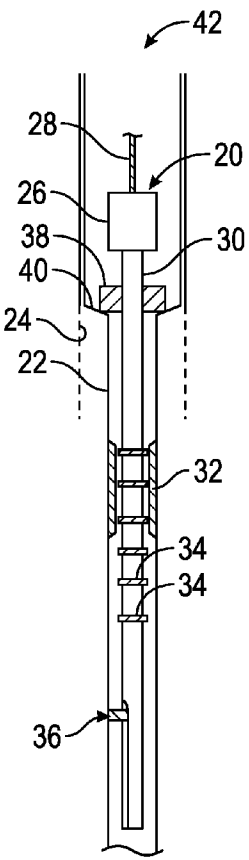
FIG. 2 is a schematic illustration similar to that of FIG. 1 but showing the submersible pumping system in a different position with respect to the settable shoulder, according to an embodiment of the disclosure.

A shoulder mechanism 38 is slidably mounted along tubular member 30 and is utilized as a settable load shoulder mechanism. Initially, the settable load shoulder mechanism 38 may be located at a lower position along tubular member 30, as illustrated in FIG. 1. The shoulder mechanism 38 remains in this position as the electric submersible pumping system 26 is run-in-hole until the shoulder mechanism 38 engages a corresponding shoulder contact region 40 of completion system 22. At this stage, the shoulder mechanism 38 has not yet been set with respect to tubular member 30 and the tubular member 30 can slide through the shoulder mechanism 38 to a desired operational position, as illustrated in FIG. 2.

Once the electric submersible pumping system 26 and tubular member 30 are at a desired position for testing and/or pumping system operation, the shoulder mechanism 38 may be selectively actuated and locked to tubular member 30. After the shoulder mechanism 38 is locked to tubular member 30, further tensile loading of cable 28 is resisted when shoulder mechanism 38 engages the corresponding shoulder contact region 40. In the example illustrated, the pumping system 20, cable 28, tubular member 30, and shoulder mechanism 38 have been combined into an embodiment of an overall well system 42. However, the overall well system 42 may utilize additional and/or other components to accommodate parameters associated with different environments and different applications.

Figure 4:
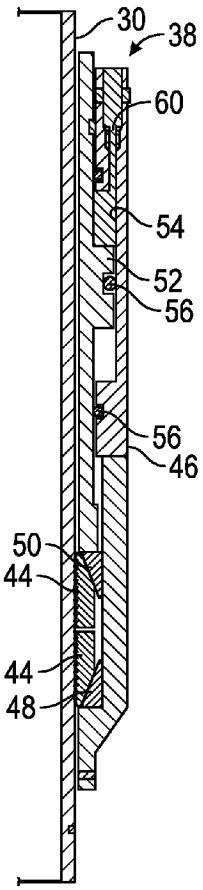
FIG. 4 is an illustration of the settable shoulder of FIG. 3 but in a set position actuated against the corresponding tubular member, according to an embodiment of the disclosure.
Figure 3:
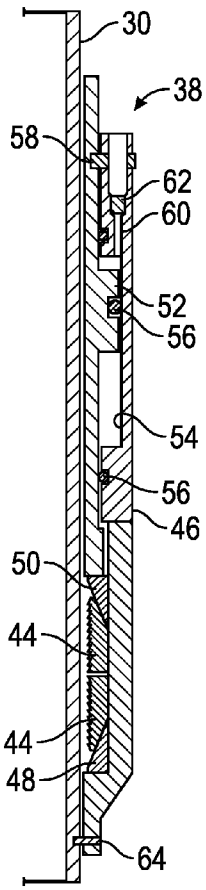
FIG. 3 is a partial cross-sectional view of an example of a settable shoulder positioned for running-in-hole with the submersible pumping system, according to an embodiment of the disclosure.

Referring generally to FIGS. 3 and 4, each of these Figures illustrates a cross-sectional view of one side of an embodiment of the settable load shoulder mechanism 38 but in different operational positions. The shoulder mechanism 38 is illustrated as deployed along tubular member 30. In this example, the shoulder mechanism 38 comprises at least one anchor 44, e.g. a plurality of anchors 44, which may be selectively moved in a radially inward direction against an exterior surface of tubular member 30. By way of example, the anchors 44 may be positioned within a shoulder mechanism housing 46 between a stationary wedge 48 and a movable wedge 50.

The movable wedge 50 is illustrated as engaged with an actuator piston 52 which is slidably mounted within housing 46 for selective movement in a linear direction, e.g. a direction aligned with tubular member 30. By way of example, the actuator piston 52 may be slidably mounted at least partially within a corresponding cylinder region 54 of shoulder mechanism housing 46. The actuator piston 52 is mounted in sealing engagement with the surrounding housing 46 via a plurality of seals 56 and may initially be held in an unactuated position via a shear member 58.

Additionally, the shoulder mechanism housing 46 comprises a fluid port 60 through which pressurized fluid may enter cylinder region 54 to move, e.g. actuate, piston 52. Prior to actuation, the fluid port 60 may be blocked with an obstruction 62 such as a rupture disc which is ruptured upon sufficient application of pressure. The fluid port 60 may be coupled with a control line or it may be exposed to the wellbore to enable selective actuation of settable load shoulder mechanism 38 via application of sufficient pressure in wellbore 24. In other embodiments, the obstruction 62 may be selectively removable via activation by an electrical signal or other command signal. For example, the obstruction may comprise an electrically operated rupture disc which is controllable via an electrical signal sent downhole. The electrical rupture disc technology is available from Schlumberger Corporation, and this technology uses the electrical signal to initiate a pyrotechnic charge which propels a plunger. The plunger, in turn, breaks a pressure membrane so the pressurized fluid may flow through port 60 to actuate shoulder mechanism 38. Effectively, this allows use of an electrical signal to selectively command setting of shoulder mechanism 38.

In some embodiments, the shoulder mechanism 38 is initially and temporarily held at a lower position along tubular member 30 (see FIG. 1) by, for example, a shear member 64. When the shoulder mechanism 38 engages the corresponding shoulder contact region 40 and sufficient set down force is applied, the shear member 64 is sheared to allow shoulder mechanism 38 to slide along tubular member 30. This allows the electric submersible pumping system 26 and the tubular member 30 to be moved to a desired location with respect to the downhole completion system 22.

Once the electric submersible pumping system 26 is deployed to the desired location (see FIG. 2), the shoulder mechanism 38 may be actuated by applying sufficient pressure at fluid port 60. The pressure initially removes the obstruction 62, e.g. ruptures the rupture disc, so that pressurized fluid may flow into cylinder region 54 on the fluid port side of the piston 52. The pressure creates sufficient force against piston 52 to shear the shear member 58 so that piston 52 is able to shift wedge 50 toward anchors 44. The continued movement of wedge 50 into anchors 44 and toward stationary wedge 48 causes the anchors 44 to shift radially inward and into engagement with tubular member 30, as illustrated in FIG. 4. The anchors 44 are set against tubular member 30 with sufficient force to counter the tensile load forces that would otherwise be applied to cable 28 during, for example, testing and/or operation of electric submersible pumping system 26. Additionally, the shoulder mechanism 38 does not add tension to cable 28 when the electric submersible pumping system 26 is retrieved to the surface.

Figure 5:
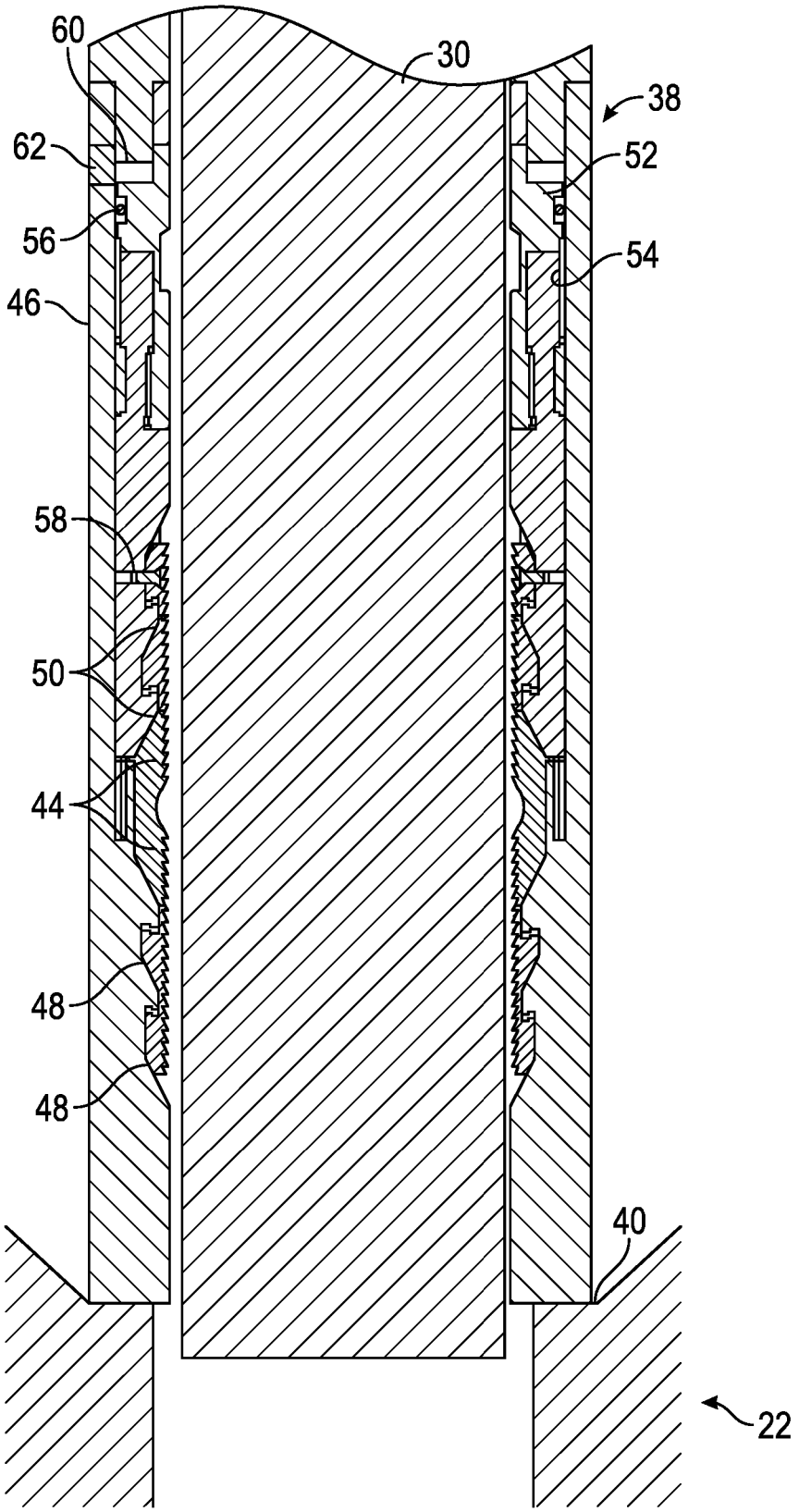
FIG. 5 is another illustration of an embodiment of the settable shoulder positioned about a corresponding tubular member, according to an embodiment of the disclosure.

In FIG. 5, a similar embodiment of shoulder mechanism 38 is illustrated in full cross-section disposed along tubular member 30. In this illustration, the housing 46 of shoulder mechanism 38 has engaged the corresponding shoulder contact region 40 of completion system 22. However, pressure has not yet been applied to shift piston 52 or to engage anchors 44 with tubular member 30.

Figure 6:
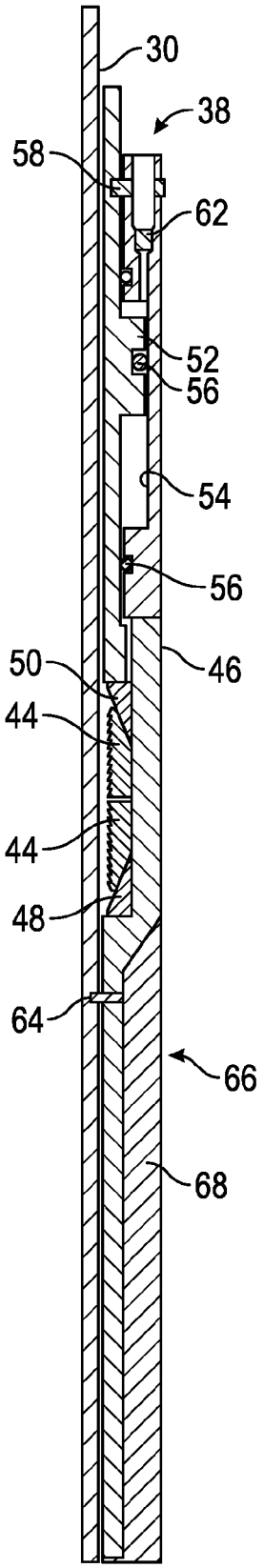
FIG. 6 is a partial cross-sectional view of another embodiment of the settable shoulder positioned about a corresponding tubular member, according to an embodiment of the disclosure.
Figure 7:
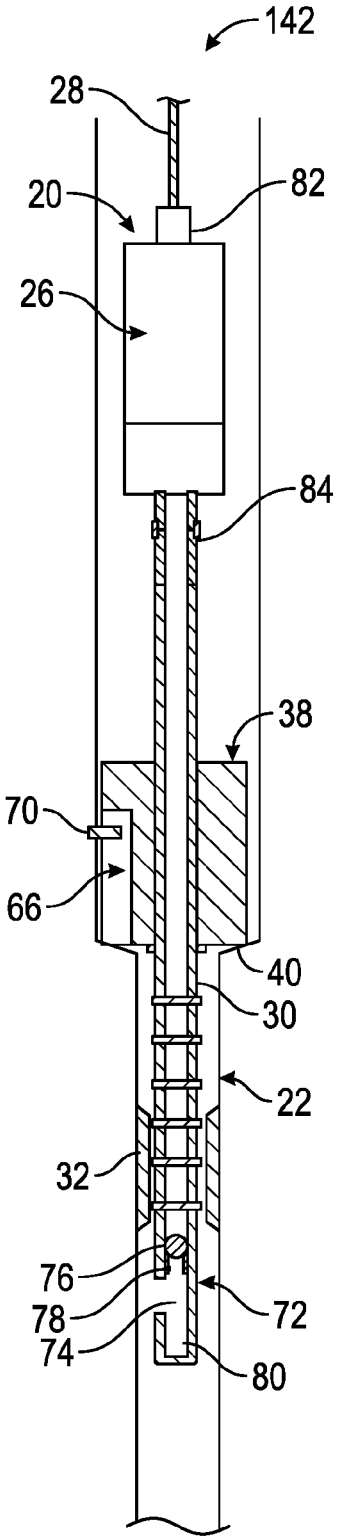
FIG. 7 is a schematic illustration of the settable shoulder of FIG. 6 combined with a submersible pumping system and deployed downhole to a completion system, according to an embodiment of the disclosure.

Referring generally to FIG. 6, another embodiment of settable shoulder mechanism 38 is illustrated. In this example, the shoulder mechanism 38 comprises an anti-torque feature 66 located to counter torque loading during, for example, operation of electric submersible pumping system 26. By way of example, the anti-torque feature 66 may comprise a shoulder or a plurality of shoulders 68, e.g splines and grooves, extending from shoulder mechanism housing 46 in a generally longitudinal direction. A corresponding anti-torque feature 70 may be positioned on completion system 22 or on other downhole equipment, as illustrated in FIG. 7. The anti-torque features 66, 70 engage each other when the electric submersible pumping system 26 is deployed to the desired downhole location, thus countering torque loads.

Depending on the application, the well system 42 may comprise additional components. By way of example, the obstruction 62 may be constructed with redundant rupture discs which are rated at rupture pressures a predetermined amount or amounts above hydrostatic pressure. By way of example, the redundant rupture discs of obstruction 62 may have rupture pressures ranging from 750 to 1250 psi above hydrostatic pressure.

Other features may include a pump out plug 72 disposed within the tubular member 30, e.g. stinger, above a flow passage 74 disposed between an interior and exterior of the tubular member 30. By way of example, the pump out plug 72 may comprise a floating ball 76 able to seal against a ball seat 78 affixed within the tubular member 30 by a shear member or other suitable mounting mechanism. The pump out plug 72 enables application of pressure within tubular member 30 to accommodate pressure testing from above.

After pressure testing, the pressure within tubular member 30 may be raised to a predetermined shear level which shears or otherwise releases the pump out plug 72 so that it may drop into a sump region 80 of tubular member 30 or to another suitable location. Once the pump out plug 72 is released, the passage or passages 74 allow free flow of, for example, production fluid into tubular member 30. The production fluid flows up the tubular member 30 to electric submersible pumping system 26 as the electric submersible pumping system 26 is operated to pump the production fluids to the surface or to another suitable location.

Figure 8:
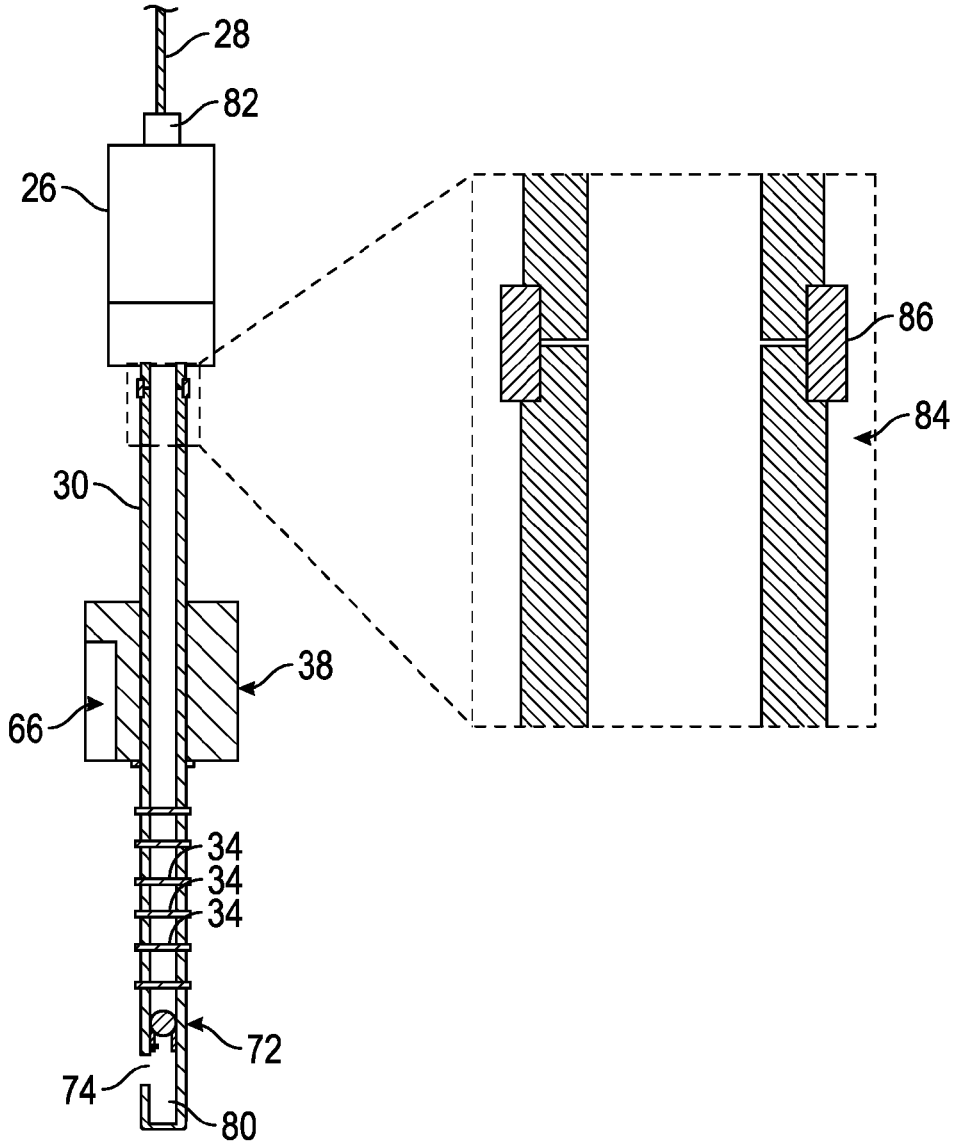
FIG. 8 is a schematic illustration of an example of the submersible pumping system with an enlarged pup joint which may be used to couple the pumping system with the tubular member, according to an embodiment of the disclosure.

In some applications, the well system 42 also may comprise a sensor 82, e.g. a load cell, positioned along the cable 28. For example, the sensor/load cell 82 may be positioned between electric submersible pumping system 26 and power cable 28. This allows monitoring of the loading, e.g. tensile loading, experienced by the cable 28. The data from the sensor 82 may be transmitted to a control system, such as a surface control system, to help ensure excessive loading is not applied to the cable 28. Additionally, some embodiments of well system 42 may utilize a pup joint 84 positioned to couple the electric submersible pumping system 26 with the tubular member 30 (as illustrated in enlarged form in FIG. 8). A controllable circulation valve 86 may be disposed along the joint 84 or at another suitable location to provide pressure access to the interior of tubular member 30.

In an operational example, the downhole completion 22 is deployed downhole into wellbore 24. In some applications, a lower completion, e.g. downhole completion 22, is initially installed, and an upper completion is deployed downhole into cooperation with the lower completion. An appropriate length for cable 28 also is determined based on placement of the downhole completion 22. The electric submersible pumping system 26, tubular member 30, and shoulder mechanism 38 are then deployed downhole to the downhole completion 22.

It should be noted the cable 28 may be suspended from a cable hanger and, in some applications, may comprise power cable having a length of greater than 10,000 feet. In some embodiments, the length of cable 28 may be determined using a depth correlation log. Based on the depth correlation log, the length of tubular member 30 is sometimes adjusted by adding a pup joint 84 having an appropriate length to facilitate engagement of electric submersible pumping system 26 with downhole completion 22.

During deployment of the electric submersible pumping system 26 downhole, tension on cable 28 may be monitored via sensor/load cell 82. In some applications, tension on cable 28 may be slightly reduced as the tubular member/stinger 30 slides into the polished bore receptacle 32 due to seal friction. As the tubular member 30 is lowered, the settable load shoulder mechanism 38 engages the corresponding shoulder contact region 40 and shear member 64 is sheared.

Figure 10:
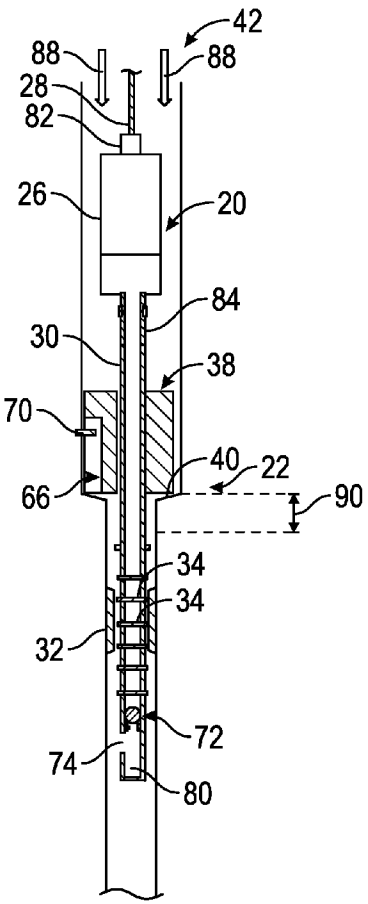
FIG. 10 is a schematic illustration of an embodiment of the pumping system once sufficient pressure has been applied to set the shoulder mechanism, according to an embodiment of the disclosure.
Figure 9:
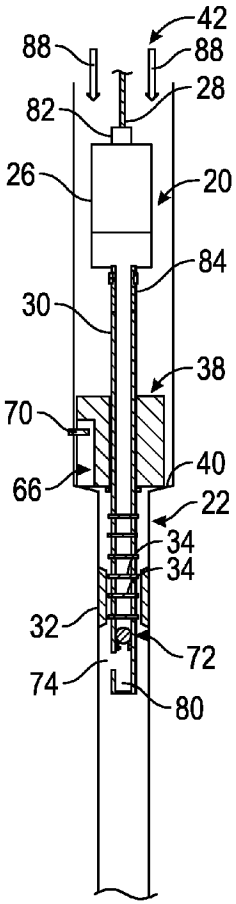
FIG. 9 is a schematic illustration of an embodiment of the pumping system as pressure is initially applied during a land out procedure, according to an embodiment of the disclosure.

At this stage, pressure may be applied down through the wellbore, as represented by arrows 88 in FIG. 9. The circulating valve 86 may be maintained in an open position as pressure is applied and the tension in cable 28 may be monitored via sensor 82. The applied pressure 88 is experienced within tubular member 30 via valve 86 and may cause a net movement 90 of tubular member 30 (and consequent movement of shoulder mechanism 38 along tubular member 30) as illustrated in FIG. 10.

Figure 11:
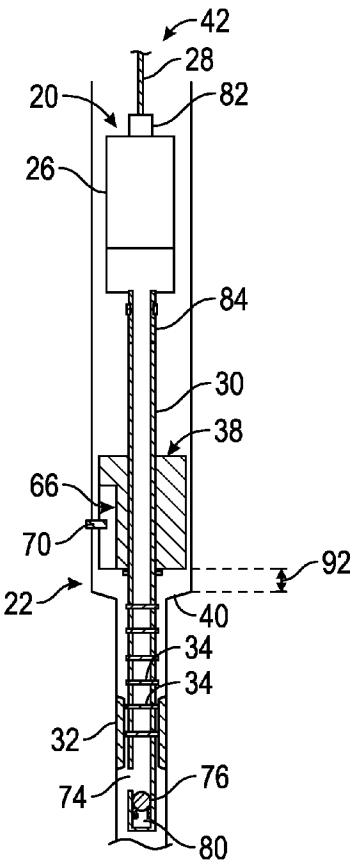
FIG. 11 is a schematic illustration of an embodiment of the pumping system following shearing of a pump out plug to enable fluid production, according to an embodiment of the disclosure.

Suitable pressures may then be applied to release shoulder mechanism piston 52 and to actuate anchors 44 into engagement with tubular member 30 so as to set shoulder mechanism 38 at a desired position along tubular member 30. Suitable pressures also may be applied to, for example, test seals and shear and release pump out plug 72. It should be noted that in this embodiment once pump out plug 72 is released, the pressure also is released through passage 74. The reduction of pressure applied in tubular member 30 can then cause the tubular member 30 and the set shoulder mechanism 38 to move upwardly a short distance 92, as illustrated in FIG. 11. When anti-rotation feature 66 is used, the feature 66 should be of sufficient length to accommodate up-and-down movements, such as movements over distances 90, 92.

The set shoulder mechanism 38 prevents undue tensile loading of the cable 28 during these set up and testing procedures. Additionally, the shoulder mechanism 38 prevents undue loading once operation of electric submersible pumping system 26 is commenced and well fluids are drawn up through tubular member 30 and then pumped via the pumping system 26. For example, operation of electric submersible pumping system 26 may produce substantial down forces, but shoulder mechanism 38 resists these down forces once the shoulder mechanism 38 is again brought into engagement with corresponding shoulder contact region 40. Consequently, the power cable 28 is protected against axial loads which exceed its load rating.

Embodiments of the overall well system 42 have been illustrated and described herein. However, various other or additional components may be used to facilitate a given application. For example, system 20 may comprise the electric submersible pumping system 26 or other types of pumping systems which may be conveyed downhole via various types of conveyances. Additionally, various fluid handling devices, sensors, packers, completion components, valves, and/or other components may be incorporated into the overall configuration.

Similarly, the shoulder mechanism 38 may have several configurations for use in a variety of well applications to pump production fluids, water, treatment fluid, or other fluids. The shoulder mechanism 38 may be used to reduce loading on cable 28, as described herein, but the shoulder mechanism 38 also may be used and selectively set to resist loading on other types of conveyances or other well components. The specific configuration of the shoulder mechanism components also may be change. For example, the anchoring mechanisms, actuating piston, shoulder mechanism housing, shear members, rupture discs, wedges, and/or other components may be changed in arrangement, number, and/or configuration to accommodate the parameters of a given operation.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in a well, comprising:

a completion system disposed in a wellbore and having a shoulder contact region;

an electric submersible pumping system deployed downhole via a cable for landing on the completion system;

a tubular member coupled to the electric submersible pumping system and extending downhole from the electric submersible pumping system; and a shoulder mechanism slidably mounted on the tubular member for engagement with the shoulder contact region during landing, the shoulder mechanism being selectively settable along the tubular member to counter tensile loading in the cable, wherein the shoulder mechanism is set against the tubular member via anchors actuated against the tubular member, and wherein the anchors are actuated by a piston movably mounted within a housing of the shoulder mechanism.

2. The system as recited in claim 1, wherein the tubular member comprises a stinger and the completion system comprises a polished bore receptacle positioned to sealingly receive the stinger.

3. The system as recited in claim 1, wherein the shoulder mechanism is temporarily secured to the tubular member by a shear member when the electric submersible pumping system is run-in-hole for landing on the completion system.

4. The system as recited in claim 1, wherein the shoulder mechanism is set with respect to the tubular member by applying pressure downhole.

5. The system as recited in claim 1, wherein the shoulder mechanism comprises a rupture disc which is initially ruptured to enable pressure to be applied to the piston.

6. The system as recited in claim 1, further comprising an anti-torque feature working in cooperation with the shoulder mechanism to resist torque loading.

7. The system as recited in claim 1, further comprising a pump out plug mounted in the tubular member to initially enable pressure buildup within the tubular member.

8. A system, comprising:

a submersible pumping system sized for deployment in a borehole;

a tubular member extending from the submersible pumping system; and a shoulder mechanism which may be shifted along the tubular member while the submersible pumping system is in the borehole, the shoulder mechanism having a setting feature by which the shoulder mechanism is selectively anchored to the tubular member, wherein the shoulder mechanism comprises a plurality of anchors selectively settable against the tubular member, and wherein anchors of the plurality of anchors are actuated via a hydraulic piston.

9. The system as recited in claim 8, further comprising a cable, the submersible pumping system being deployed downhole into the borehole via the cable.

10. The system as recited in claim 9, further comprising a downhole completion system having a shoulder contact region oriented to engage the shoulder mechanism.

11. The system as recited in claim 10, wherein the submersible pumping system is an electric submersible pumping system.

12. A method, comprising:

connecting an electric submersible pumping system to a power cable;

coupling a shoulder mechanism to the electric submersible pumping system via a stinger, deploying the electric submersible pumping system downhole into a wellbore via the power cable until the shoulder mechanism engages a shoulder contact region of a downhole completion;

allowing the shoulder mechanism to slide along the stinger; and selectively locking the shoulder mechanism to the stinger to counter loading on the power cable, wherein selectively locking comprises shifting an anchor against the stinger via a pressure actuated piston.

13. The method as recited in claim 12, wherein deploying comprises moving the stinger into sealing engagement with a polished bore receptacle.

14. The method as recited in claim 12, wherein selectively locking comprises initiating shifting of the anchor by sending an electrical command signal downhole.

15. The method as recited in claim 12, further comprising applying pressure in the wellbore to shift the pressure actuated piston.

* * * * *